US011618128B2

(12) United States Patent
Kivisto

(10) Patent No.: US 11,618,128 B2
(45) Date of Patent: Apr. 4, 2023

(54) TEMPERATURE CONTROL FOR BLAST WHEEL HOUSING

(71) Applicant: National Flooring Equipment, Inc., Minneapolis, MN (US)

(72) Inventor: John A. Kivisto, Oak Grove, MN (US)

(73) Assignee: NATIONAL FLOORING EQUIPMENT, INC., Minneapolis, MN (US)

( * ) Notice: Subject to any disclaimer, the term of this patent is extended or adjusted under 35 U.S.C. 154(b) by 0 days.

(21) Appl. No.: 17/831,984

(22) Filed: Jun. 3, 2022

(65) Prior Publication Data

US 2022/0288745 A1 Sep. 15, 2022

Related U.S. Application Data

(62) Division of application No. 16/460,012, filed on Jul. 2, 2019, now Pat. No. 11,498,184.

(51) Int. Cl.

| | |
|---|---|
| ***B24C 1/08*** | (2006.01) |
| ***B24C 3/06*** | (2006.01) |
| ***B24C 3/14*** | (2006.01) |

(52) U.S. Cl.

CPC ..... *B24C 1/086* (2013.01); *B24C 3/06* (2013.01); *B24C 3/14* (2013.01)

(58) Field of Classification Search

CPC ..... B24C 9/003; B24C 3/065; B24C 5/066; B24C 5/062; B24C 5/068; B24C 3/06

USPC ..... 451/65, 97, 95, 92, 87, 88, 75

See application file for complete search history.

(56) References Cited

U.S. PATENT DOCUMENTS

| | | | | |
|---|---|---|---|---|
| 5,024,028 | A | 6/1991 | Pierce et al. | |
| 5,231,805 | A * | 8/1993 | Sander | B24C 1/086 451/92 |

FOREIGN PATENT DOCUMENTS

| | | | |
|---|---|---|---|
| CN | 104659960 | | 5/2015 |
| EP | 0032161 | | 7/1981 |
| EP | 0041797 | | 12/1981 |
| FR | 2410538 | A1 | 6/1979 |
| GB | 920488 | A | 3/1963 |
| GB | 1477112 | A | 6/1977 |
| JP | S51119591 | A | 10/1976 |
| JP | 2011098422 | | 5/2011 |
| KR | 200324381 | Y1 | 8/2003 |
| SU | 812552 | A1 | 3/1981 |

OTHER PUBLICATIONS

European Patent Office, Communication for Application No. 20835203.9, Extended European Search Report includes the Supplementary European Search Report and the European search opinion dated Oct. 27, 2022, 10 pages.

* cited by examiner

*Primary Examiner* — Katina N. Henson

(74) *Attorney, Agent, or Firm* — Bradley J. Thorson; DeWitt LLP

(57) ABSTRACT

The temperature of the chamber housing a shot wheel of a shot blaster is controlled by positioning a fan exterior to the chamber that creates air flow across a mounting plate defining the chamber. The air flow created by the fan may also pass around the bearing surrounding the drive shaft that turns the shot wheel.

7 Claims, 4 Drawing Sheets

TEMPERATURE CONTROL FOR BLAST WHEEL HOUSING

CROSS-REFERENCED TO RELATED APPLICATIONS

The present application is a division of U.S. patent application Ser. No. 16/460,012, filed on Jul. 2, 2019, titled Temperature Control for Blast Wheel Housing, listing John A. Kivisto as inventor.

STATEMENT REGARDING FEDERALLY SPONSORED RESEARCH OR DEVELOPMENT

Not applicable

BACKGROUND OF THE INVENTION

I. Field of the Invention

The present invention relates to equipment used to prepare a floor for refinishing. More specifically, the present invention relates to shot blasters.

II. Discussion of the Prior Art

Various types of devices are employed to prepare a floor for refinishing. This includes machines designed to scrape tile and carpet from a floor, polishers, grinders, burnishers and shot blasters. National Flooring Equipment, Inc. of Minneapolis, Minn., has been a leading manufacturer and distributor of such equipment for sixty years.

Many concrete floors in commercial building and residential garages are finished with epoxy coatings. Over time resurfacing is required. The original surface must be roughened up to permit the new layer of epoxy to properly adhere to the floor. This step of roughening the floor may be performed using a grinder or a shot blaster.

A shot blaster is designed to blast small metal pellets (shot) onto the floor's surface. Shot blasters typically include a reservoir containing a supply of shot, a mechanism for metering the delivery of the shot, an impeller (referred to as a blast wheel) that provides the force to blast the metered shot at the floor, and plenum attached to a powerful vacuum that collects the used shot, as well as the dust and debris generated by the shot blasting processes. National Flooring Equipment offers a series of shot blasters of different sizes and configurations. These include the National HB5 handheld shot blaster, the National A30 self-propelled shot blaster, and the National A12 ride-on shot blaster. While all the shot blasters offered by National are of high quality and effectively treat the floor, National is continually trying to improve its equipment offerings.

The blast wheel of a shot blaster is enclosed in a blast wheel housing which, in some respects, acts like the barrel of a shotgun used for hunting. The housing contains and directs the shot to the desired location on the floor to be treated. The housing also protects the user of the machine and others in the vicinity of the machine from being struck and injured by shot ejected from the blast wheel.

During use, this house heats up due to friction. Such friction results from the spinning of the blast wheel, the pieces of shot rubbing up against each other as they are blasted toward the floor, and the pieces of shot impacting the surfaces of the housing and the parts contained within the housing, including the blast wheel itself.

The elevated temperatures caused by friction have been known to warp the metal used to form the housing. Also, elevated temperatures within the housing can reduce the life of the blast wheel itself. Even under ideal conditions, the blast wheel must be replaced periodically, typically after less than 100 hours of use.

In some cases, the warpage has been so significant that the warped housing makes it more difficult or even impossible to change the blast wheel requiring the housing, itself, be replaced.

Adding heat vents to allow hot gasses to escape from the housing without further modifications to the housing is not an option. This is because shot could also escape through such vents. This would create a mess. This would also damage equipment, fixtures and other objects in the area where the machine is being operated. This could also cause injury to the operator or others in the area. As such, a real need exists to find another way to control the temperature of the blast wheel housing.

SUMMARY OF THE INVENTION

The present invention provides various improvements related to heat control and the dissipation of heat that can otherwise damage the components of a shot baster.

As noted above, a shot blaster typically includes a housing defining an interior chamber. In the case of the present invention, the housing comprises a mounting plate having an interior surface facing the interior chamber, an exterior surface, and a drive shaft orifice.

A blast wheel is coupled to a drive shaft and positioned within the interior chamber of the housing. The drive shaft extends from the blast wheel through the drive shaft orifice. A bearing is mounted to exterior surface of the mounting plate. The bearing surrounds a portion of the drive shaft and encloses the drive shaft orifice. A first motor is coupled to the drive shaft. This motor turns the drive shaft which, in turn, drives the blast wheel.

A fan is mounted outside of the interior chamber. The fan is directed to create airflow across the exterior surface of the mounting plate and around the bearing. This fan dissipate heat from the interior of the chamber. More specifically, the air passing over the exterior surface of the mounting plate and around the bearing draws heat away from these structures creating a greater temperature differential that causes heat from inside of the interior chamber to be transmitted to the outside through the mounting plate and bearing.

In some embodiments, the housing has at least one wall extending at an angle from the mounting plate adjacent the bearing. Such a wall may be present for various reasons, for example to reinforce the shot blaster assembly or to support other structures. In some cases, the wall will be positioned between the first motor and the bearing. When so positioned, the wall directs heat generated by the first motor away from the area of the housing immediately adjacent the interior chamber of the housing. The wall, no matter where positioned, may include one or more vents that cooperate with the fan.

The fan has a suction side and a discharge side. The location of the wall will dictate whether the suction side or discharge side of the fan should face the vent(s). When the suction side faces toward the vent(s), air passes through the vents before reaching the fan and being blown by the fan across the mounting plate and around the bearing. This arrangement may be preferred when the wall is not between the motor and the bearing. When the wall is between the motor and the bearing, it may be preferable to position the discharge side of the fan toward the vent(s).

The fan includes a blade and some means to rotate the blade to create airflow. In most cases, the fan will comprise a blade driven by a second motor. However, the blade could also be driven by the first motor without deviating from the invention. For example, the fan could be mounted to the drive shaft to which the blast wheel is mounted or to a separate drive shaft also driven by the first motor. For safety reasons the fan blade will typically reside in an enclosure. The fan blade enclosure does not unduly impede air flow generated by the fan.

BRIEF DESCRIPTION OF THE DRAWINGS

The foregoing features, objects and advantages of the invention will become apparent to those skilled in the art from the following detailed description of the preferred embodiment, especially when considered in conjunction with the accompanying drawings in which like numerals in the several views refer to corresponding parts.

DESCRIPTION OF THE PREFERRED EMBODIMENT

Figure 1:
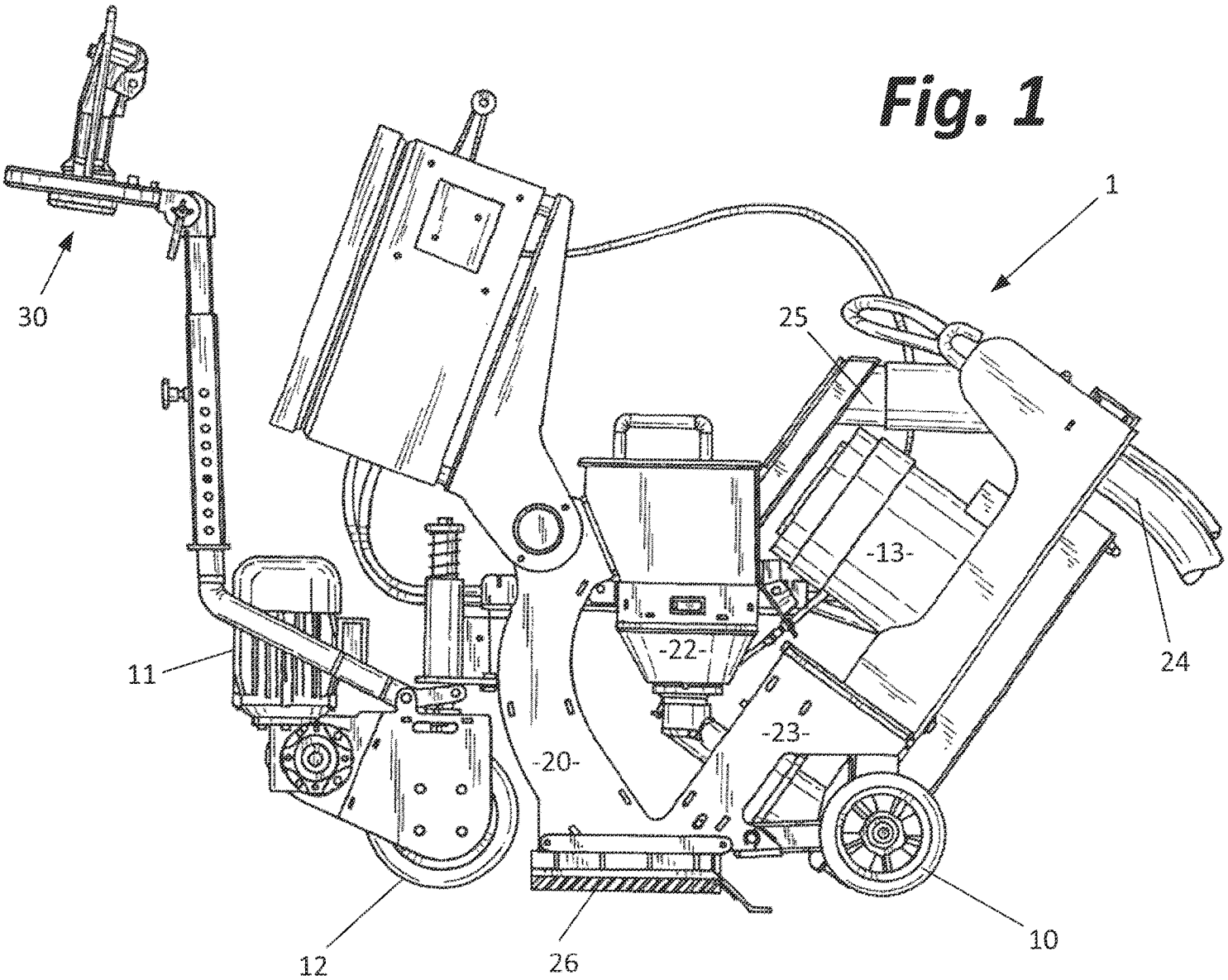
FIG. 1 is a side view of a shot blaster.

This description of the preferred embodiments is intended to be read in connection with the accompanying drawings, which are to be considered part of the entire written description of this invention. In the description, relative terms such as "lower", "upper", "horizontal", "vertical", "above", "below", "up", "down", "top" and "bottom" as well as derivatives thereof (e.g., "horizontally", "downwardly", "upwardly", etc.) should be construed to refer to the orientation as then described or as shown in the drawings under discussion. These relative terms are for convenience of description and do not require that the apparatus be constructed or operated in a particular orientation. Terms such as "connected", "connecting", "attached", "attaching", "join" and "joining" are used interchangeably and refer to one structure or surface being secured to another structure or surface or integrally fabricated in one piece, unless expressively described otherwise.

A self-propelled shot blasting machine 1 is shown in FIG. 1, The machine 1 sits on a pair of rear wheels 10 and a front drive wheel 12.

Machine 1 is driven by an electric motor 11 coupled to drive wheel 12. The machine 1 has a second motor 13 that drives a blast wheel 14.

The machine 1 also has a plenum 20 incorporating a hopper 22 and a housing 23 surrounding the blast wheel 14. The plenum 20 is coupled to one end of a vacuum tube 24 by a fitting (or port) 25. The other end of the vacuum tube 24 is coupled to a vacuum (not shown).

Hopper 22 is filled with shot prior to use. The vacuum is then energized to create air flow through the vacuum tube 24 and plenum 20. The motors 11 and 13 are then energized. Energizing motor 13 causes the blast wheel 14 to spin. Shot is metered from hopper 22 through a valve into the housing 23 where the blast wheel 14 is located. The blast wheel 14 accelerates the shot toward a spout opening 28 at the base of the housing 23 adjacent the floor and in an area contained by a suction head 26. As the shot impacts the floor's surface roughening the surface, the shot, together with floor debris and dust, are carried through the plenum 20 by the air flow. The dust and debris are carried to the vacuum. The shot is deposited back into the hopper and recycled.

Operation of the two motors 11 and 13 and the speed and direction of the machine are controlled by ergonomic controller 30.

The housing 23 has an interior chamber 52 in communication with spout opening 28. The housing 23 comprises a mounting plate 54 having an interior surface 56 facing the interior chamber 52, an exterior surface 58, and a drive shaft orifice 60.

A blast wheel 14 is coupled to a drive shaft 62 and positioned within the interior chamber 52 of the housing 23. The drive shaft 62 extends from the blast wheel 14 through the drive shaft orifice 60. A bearing 64 is mounted to exterior surface 58 of the mounting plate 54. The bearing 64 surrounds a portion of the drive shaft 62 and encloses the drive shaft orifice 60. Motor 13 is coupled to the drive shaft 62. Various elements may be employed to couple the drive shaft 62 to the motor 13, for example a chain and a pair of sprockets, or a belt and a pair of pullies. In any case, the motor 13 turns the drive shaft 62 which, in turn, drives the blast wheel 14.

A fan 70 is mounted outside of the interior chamber 52. The fan is 70 directed to create airflow across the exterior surface 58 of the mounting plate 54 and around the bearing 64. This fan dissipates heat from the interior chamber 52. More specifically, the air passing over the exterior surface 58 of the mounting plate 54 and around the bearing 64 draws heat away from these structures creating a greater temperature differential that causes heat from inside of the interior chamber 52 to be transmitted to the outside through the mounting plate 54 and bearing 64.

In some embodiments, the housing has at least one wall 72 extending at an angle from the mounting plate 54 adjacent the bearing 64. Such a wall may be present for various reasons, for example to reinforce the shot blaster assembly generally or to support specific structures of the assembly. In some cases, the wall 72 will be positioned between the motor 13 and the bearing 64. When so positioned, the wall 72 directs heat generated by the motor 13 away from the area of the immediately adjacent the interior chamber 52 of the housing 23. The wall 72, no matter where positioned, may include one or more vents 74/75 that cooperate with the fan 70.

The fan 70 has a suction side and a discharge side. The location of the wall 72 will dictate whether the suction side or discharge side of the fan 70 should face the vent(s) 74. When the suction side faces toward the vent(s) 74, air passes through the vents 74 before reaching the fan 70 and being blown by the fan 70 across the mounting plate 54 and around the bearing 64. This arrangement may be preferred when the wall is not between the motor and the bearing. When the wall 72 is between the motor 13 and the bearing 64, it may be preferable to position the discharge side of the fan 70 toward the vent(s) 74.

The fan 70 includes a blade 76 and some means to rotate the blade to create airflow. In most cases, the fan 70 will comprise a blade driven by an additional motor. However, the blade could also be driven by motor 13 without deviating from the invention. For example, the fan 70 could be mounted to the drive shaft 62 to which the blast wheel 14 is mounted or to a separate drive shaft also driven by the motor 13. For safety reasons the fan blade will typically reside in an enclosure 77 that does not unduly impede air flow generated with the fan.

Figure 4:
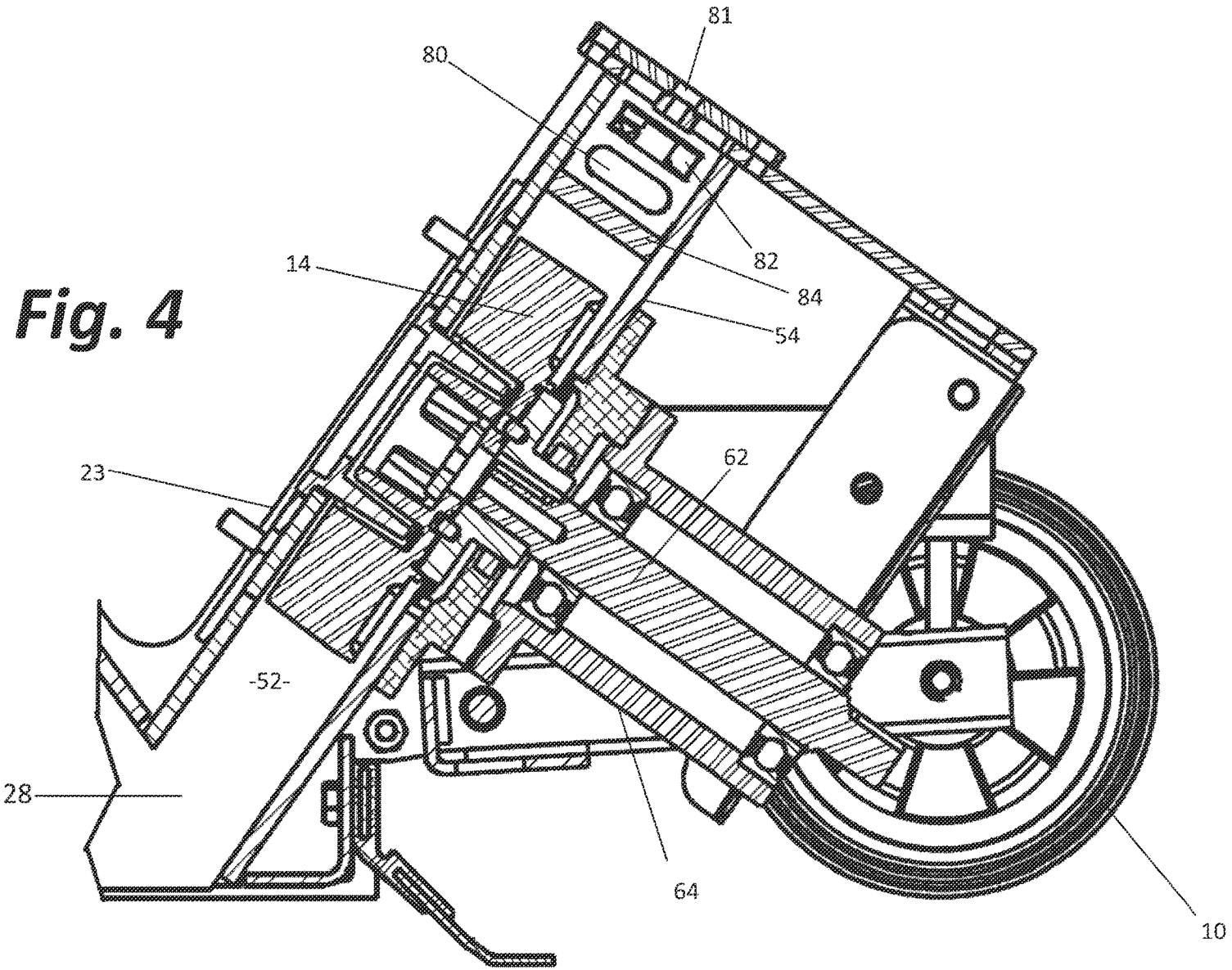
FIG. 4 is a cross-sectional view of an alternative embodiment showing the blast wheel housing directly vented with a fan inside.

FIG. 4 shows an alternative embodiment of the present invention. This embodiment includes modifications to the blast wheel housing 23. Specifically, vents 80 and 81 have been added to the exterior walls of the blast wheel housing to provide air flow through the interior chamber 52 of the blast wheel housing 23. The blast wheel housing has been further modified to include a liner 84 between the blast wheel 14 and the vents 80 and 81.

The liner 84 may be an imperforate metal sheet. When this is the case, only the region of the interior chamber 52 of blast wheel housing 23 between the liner 84 and the vents 80/81 is directly vented. Heat generated in other parts of the interior chamber 52 is dissipated via conduction through the liner 84 and then carried out of the housing 23 by air flow through vents 80/81. This airflow may be enhanced by employing a fan 82. Fan 82 is shown positioned within the interior chamber 52 of blast wheel housing 23 adjacent vent 81. The liner 84 separates the fan 82 from the blast wheel 14. As such, the liner 84 isolates and protects the fan 82 (and the vents 80/81) from shot flying off the blast wheel 14. The fan 82 could also be mounted outside of the housing 23 adjacent one of the vents 80/81 to make assembly easier.

For even greater air flow through the housing 23, the liner 84 may be semi-permeable. Specifically, the liner 84 may be formed as a mesh with pores large enough to permit air to pass through the liner 84 and small enough to prevent shot or other particles flying off the blast wheel from passing through the liner 84.

As noted above and shown in FIG. 1, the blast wheel housing 23 is part of (or at least in fluid communication with) the plenum 20. The plenum 20 is coupled to a vacuum tube 24 which is attached to a vacuum (not shown). When the vents 80/81 are provided, the liner is semi-permeable and the vacuum is energized, the vacuum will draw air in through the vents 80/81, the liner 84, and the rest of the interior chamber 52. This air will exit the interior chamber 52 through the spout opening 28. The fan 81 may again be provided to enhance such air flow through the interior chamber and out the spout opening 28.

Figure 2:
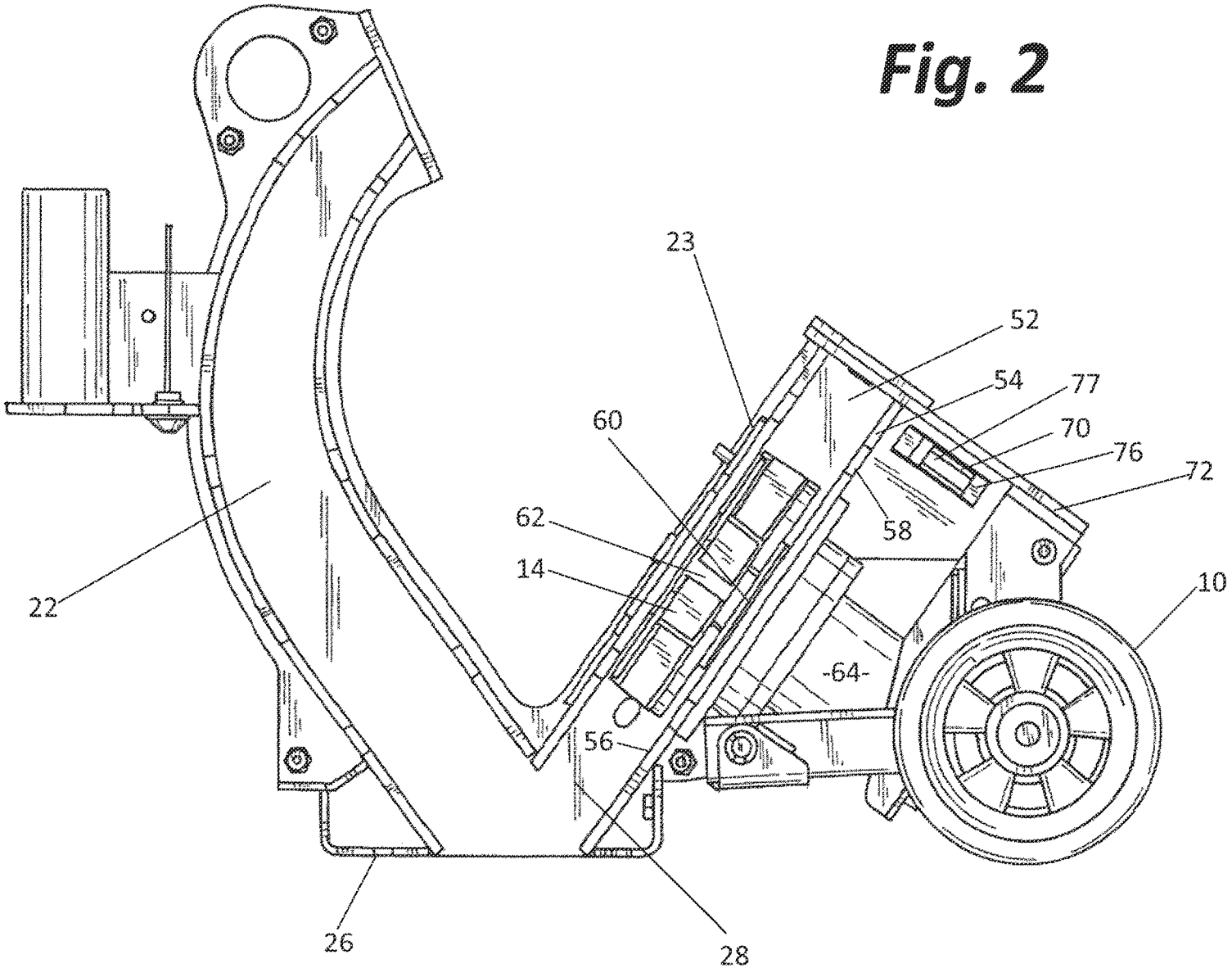
FIG. 2 is a cross-sectional view showing the blast wheel within a housing and an embodiment of the temperature control mechanism of the present invention.
Figure 3:
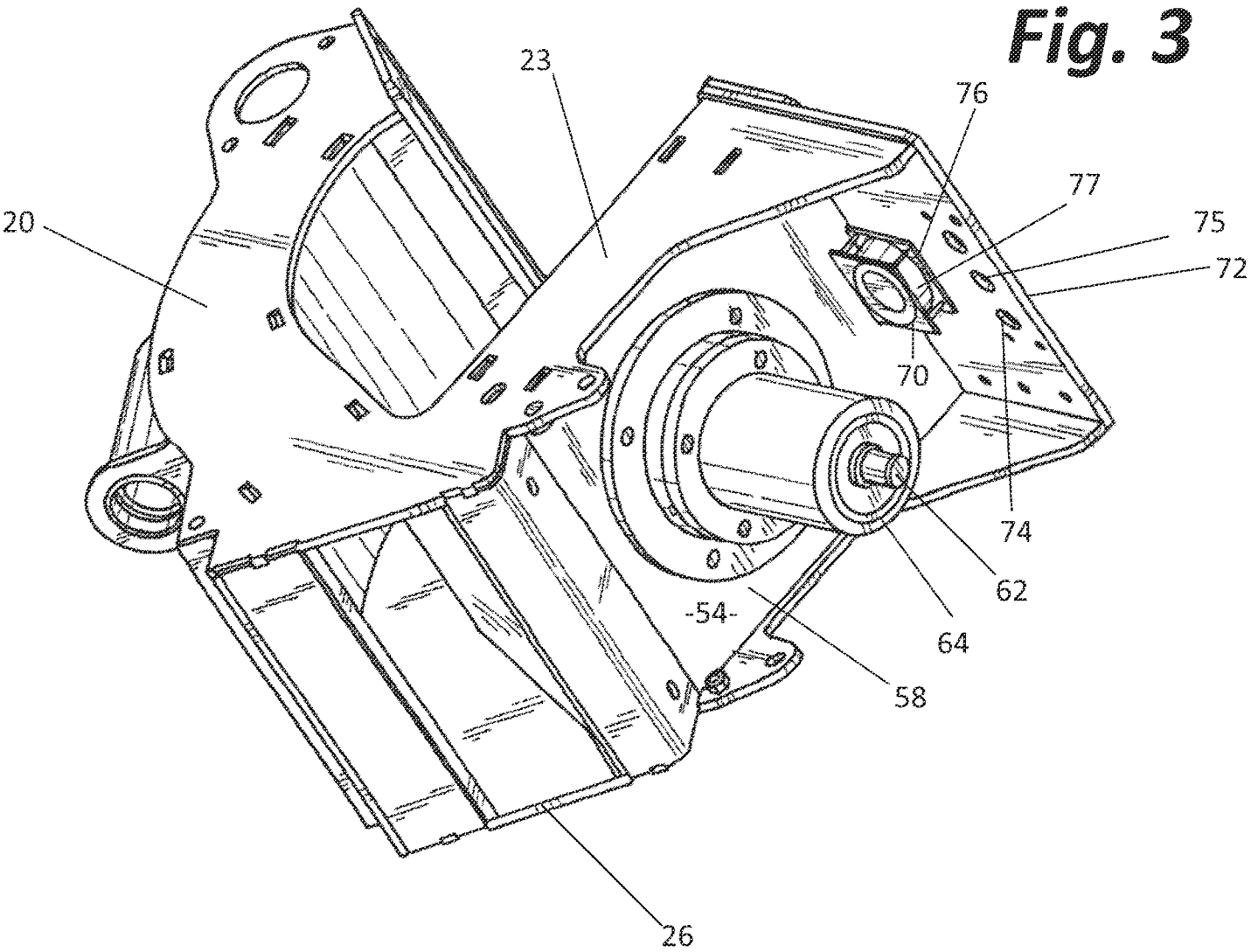
FIG. 3 is an alterative view of the temperature control mechanism of FIG. 2.

The embodiments shown in FIGS. 2 and 4 may, of course, be combined to enhance cooling and heat dissipation from the interior chamber.

In such cases, direct vents such as 80/81 are provided and indirect vents such as 74/75 are provided. As used herein, a "direct vent" is a vent that provides a flow path for air between the exterior of blast wheel housing 23 and the interior chamber 52; and an "indirect vent" is a vent that provides a flow path for air across exterior walls of the blast wheel housing 22 or other exterior structures associated with housing 23 that will conduct heat from the interior chamber 52 of blast wheel housing 23. Fans such as 82 may be provided to enhance air flow through the direct vents 80/81 and fans such as 70 may be provided to enhance air flow through the indirect vents 74/75.

This invention has been described herein in considerable detail in order to comply with the patent statutes and to provide those skilled in the art with the information needed to apply the novel principles and to construct and use embodiments of the example as required. However, it is to be understood that the invention can be carried out by specifically different devices and that various modifications can be accomplished without departing from the scope of the invention itself.

What is claimed is:

1. A shot blaster comprising:

a. a plenum coupled to a first end of a vacuum tube and comprising a hopper and a blast wheel housing defining an interior chamber, said blast wheel housing comprising a mounting plate and at least one wall, said mounting plate comprising an interior surface facing the interior chamber, an exterior surface, and a drive shaft orifice, said at least one wall comprising an interior surface facing the interior chamber and an outer surface external to the shot blaster;

b. a blast wheel coupled to a drive shaft, said blast wheel positioned within the interior chamber of the blast wheel housing and said drive shaft extending from the blast wheel through the drive shaft orifice;

c. a bearing mounted to the exterior surface of the mounting plate, surrounding a portion of the drive shaft, and closing the drive shaft orifice;

d. a first motor coupled to the drive shaft; and e. a first direct vent extending through said at least one wall and adapted to provide airflow directly between the interior chamber of the blast wheel housing and atmosphere external to the shot blaster; and f. a liner within the housing positioned between the blast wheel and the at least one first vent, said liner adapted to isolate said first direct vent from shot flying off the blast wheel to prevent shot from exiting the housing through the at least one first direct vent, wherein said liner is semi-permeable thereby permitting air to flow through the liner.

2. The shot blaster of claim 1 further comprising a second vent, and wherein said liner is further adapted to isolate said second vent from shot flying off the blast wheel.

3. The shot blaster of claim 1 further comprising a fan adapted to enhance air flow through the first direct vent.

4. The shot blaster of claim 3 wherein said fan is positioned within the interior chamber and said liner is also positioned between said blast wheel and said fan.

5. The shot blaster of claim 1 further comprising a second wall extending away from said blast wheel housing from the exterior surface of the mounting plate and an indirect vent extending through said second wall, said indirect vent adapted to provide means for providing airflow to dissipate heat conducted through the mounting plate from the interior chamber.

6. The shot blaster of claim 1 further comprising a fan adapted to provide airflow across the exterior surface of the mounting plate and around the bearing.

7. The shot blaster of claim 5 further comprising a fan adapted to provide airflow through said indirect vent.

* * * * *